US007431558B2

(12) United States Patent
Krempel et al.

(10) Patent No.: US 7,431,558 B2
(45) Date of Patent: Oct. 7, 2008

(54) AIR INTAKE

(75) Inventors: Gunter Krempel, Bad Rodach (DE); Ralph Stroehla, Meeder (DE)

(73) Assignee: Valeo Klimasysteme GmbH, Bad Rodach (DE)

( * ) Notice: Subject to any disclaimer, the term of this patent is extended or adjusted under 35 U.S.C. 154(b) by 499 days.

(21) Appl. No.: 11/092,457

(22) Filed: Mar. 29, 2005

(65) Prior Publication Data

US 2005/0217624 A1 Oct. 6, 2005

(30) Foreign Application Priority Data

Mar. 31, 2004 (DE) ..... 10 2004 015 829

(51) Int. Cl.
*F04D 29/40* (2006.01)

(52) U.S. Cl. ..... 415/102; 415/119; 415/151; 415/191; 415/208.2; 415/210.1; 415/185; 454/121; 454/126

(58) Field of Classification Search ..... 415/101, 415/102, 119, 151, 183, 185, 189–191, 208.2, 415/209.2, 209.3, 209.4, 210.1; 454/121, 454/126

See application file for complete search history.

(56) References Cited

U.S. PATENT DOCUMENTS

| | | | | |
|---|---|---|---|---|
| 1,931,692 | A * | 10/1933 | Good | 415/191 |
| 2,169,232 | A * | 8/1939 | Flanders | 415/183 |
| 3,019,963 | A * | 2/1962 | Eck | 415/183 |
| 3,107,046 | A * | 10/1963 | Frankel et al. | 415/191 |
| 6,030,286 | A * | 2/2000 | Kameoka et al. | 454/121 |
| 2004/0009061 | A1 * | 1/2004 | McDonald | 415/151 |

FOREIGN PATENT DOCUMENTS

| | | |
|---|---|---|
| DE | 198 39 729 A1 | 12/1999 |
| DE | 199 63 796 A1 | 7/2000 |
| GB | 23 91 265 A | 2/2004 |

* cited by examiner

*Primary Examiner*—Christopher Verdier
(74) *Attorney, Agent, or Firm*—Howard & Howard Attorneys, P.C.

(57) ABSTRACT

An air intake with at least one inlet port area and one outlet port area, in which there is arranged at least one structure which may be flowed through and around, comprises an opening and modifies the clear cross-section only slightly, in particular serving as a fresh air/recirculated air housing for a motor vehicle heating, ventilation and/or air-conditioning system.

10 Claims, 1 Drawing Sheet

AIR INTAKE

The present invention relates in general to an air intake. In particular, the invention relates to the field of flow-related noise reduction and is especially applicable in the area of air flow control in motor vehicle air-conditioning systems, wherein such an air intake is conventionally connected upstream of a fan with regard to flow and may for example serve as a so-called fresh air/recirculated air housing.

It is generally conventional for high flow rates to be present in air intakes, which may result in undesirable noise generation in certain applications, in particular if so-called eddies arise.

It is accordingly an object of the present invention to provide an air intake which may counter the generation of flow noise.

In particular, the invention proposes an air intake with at least one inlet port area and one outlet port area, in which there is arranged at least one structure which may be flowed through and around, comprises an opening and modifies the clear cross-section only slightly.

Extremely surprisingly, the applicant has established that eddy formation may be effectively and very simply prevented, if a structure defining an opening is arranged in this area and the fluid, such as for example air, is thus allowed to pass both through the opening and also to the outside of the structure. The solution according to the invention is especially surprising in that the structure is effective at reducing noise without the direction of flow itself needing to be greatly deflected in order, for example, to counter the above-mentioned eddy formation. In other words, no radially extending baffles are necessary, as would have been assumed by the person skilled in the art or as is proposed, for example, for the inside of a fan impeller according to EP-A-0976592.

Advantageously, the structure is oriented substantially parallel to the outlet port area and is in particular preferably located virtually therein. This arrangement makes it possible to ensure that the structure does not require any additional structural space and also does not cause any noteworthy pressure differences.

Preferably, the structure comprises a wall which is of substantially annular construction in order to define the opening. An annular wall may be particularly simple to be produce, e.g. using an injection moulding process, wherein the annular structure may be fixed to the air intake wall for example by means of radial struts. Another reason why an annular structure is surprising as an effective means of reducing noise is that it was not to be expected that a spiral flow (eddy) could be simply prevented by a geometrically similar shape.

Noise may be particularly effectively reduced if the structure exhibits a span in the flow direction of between 0.35 times and 0.5 times the corresponding span of the inlet port area. If an annular structure is selected, for example, the length of this ring should be adapted accordingly to the diameter of the inlet port area.

In addition, the applicant has established that a particularly marked reduction in noise may be achieved if the clear cross-section of the opening in the structure amounts to between 0.1 times and 0.3 times the clear cross-section of the outlet port area. In the example of an annular structure which is arranged in a substantially circular outlet port area, it is thus the case that the diameter of the ring should be between approximately 0.4 times and 0.6 times the diameter of the outlet port area, wherein it has proven particularly advantageous for this value to correspond to approximately 0.52 times the diameter of the outlet port area.

Advantageously, the structure and in particular the wall defining the opening is substantially coaxial and/or similar in shape to the outlet port area. This configuration allows the structure to be fixed in particularly stable manner in the port area, e.g. simply by appropriate struts. In addition, this makes a development possible which may ensure entirely even flow around and through the structure.

According to a preferred embodiment, at least two inlet port areas are provided, in particular equipped with an intermediate inlet port area control means, which may for example close off one or the other port area, or indeed partly open both port areas.

The noise-reducing action is, moreover, particularly marked if the inlet port area and outlet port area are offset, i.e. if an angle, which may amount for example to 90°, is formed with respect to the inlet port area or the inlet port areas and the outlet port area.

Although the air intake according to the invention may be used for a very wide range of applications, it is preferable for the air intake to take the form of a fan air intake, wherein a particularly preferred development provides air supply to a fan in an axial direction, since the above-mentioned eddy formation is often found in particular in these applications.

Finally, it is preferable for the air intake to take the form of a fresh air/recirculated air housing, as is conventionally connected upstream of the fan in motor vehicle heating, ventilation and/or air-conditioning systems.

Further advantages and features of the present invention are clearly revealed by a reading of the following description, given merely by way of example, of a currently preferred embodiment, in which description reference is made to the attached drawings, in which.

Figure 1:
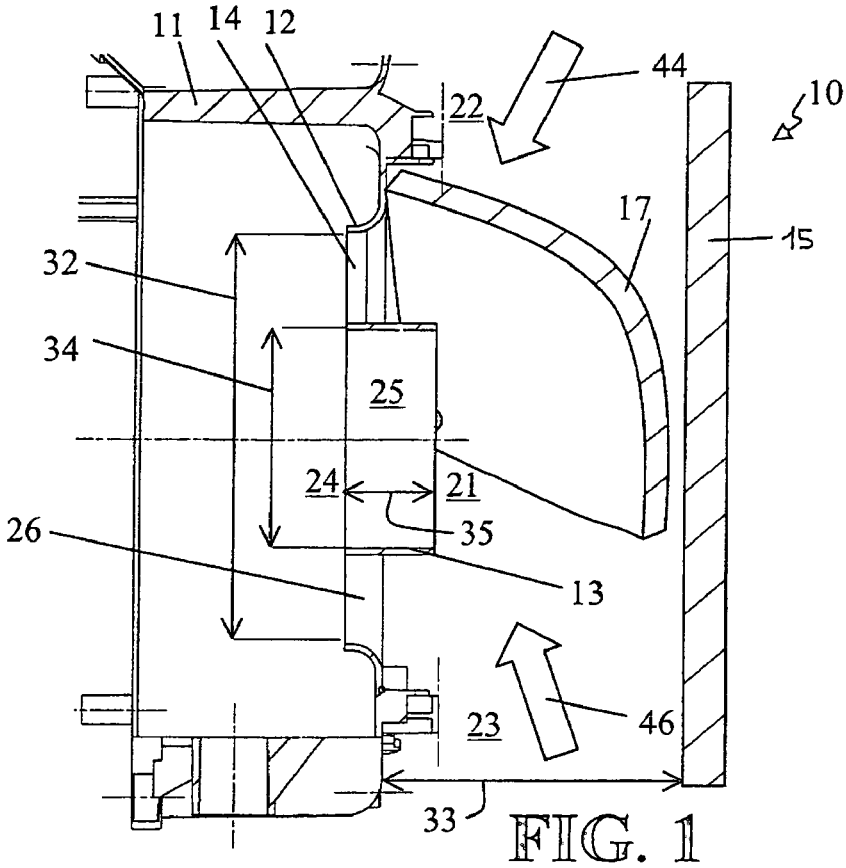
FIG. 1 is a schematic sectional view of a fresh air/recirculated air housing, as preferred embodiment of an air intake according to the invention.

FIG. 1 shows a schematic sectional view of a fresh air/recirculated air housing 10 with a housing wall 15, which is mounted relative to a fan housing 11 and there defines by means of a flow-adapted wall 12 outlet port areas 21, 24. In the outlet port areas 21, 24 there is arranged a structure comprising an opening 25, in such a way that an outlet port area 21 situated upstream of the structure with regard to flow and which is supplied with an air stream is connected with an area connected downstream of the structure with regard to flow via the opening 25, and also via further openings 26, such that the structure may be effectively flowed though and around without the clear cross-section being greatly reduced. The opening 25 is of circular construction and is arranged concentrically relative to an impeller of a radial fan, not shown, which is connected to the air intake at the vicinity of the outlet port area 24. The further openings 26 serving in flow around the structure take the form of a ring which is concentric in relation thereto.

The fresh air/recirculated air housing 10 comprises a fresh air feed 22, in which a fresh air stream 44 is guided, and a recirculated air feed 23, in which a recirculated air stream 46 is guided, both of which open in the area 21 of the outlet port area 21, 24 upstream of the structure. In the embodiment shown in FIG. 1, the inlet port areas (22, 23) are at an angle relative to the outlet port areas (21, 24), in particular substantially perpendicular thereto. The fresh air/recirculated air housing 10 comprises a recirculated air valve 17 which serves as an intermediate inlet port area control means, which makes it possible to regulate the proportions of the fresh air stream 44 and the recirculated air stream 46. The recirculated air valve 17 may take the form, for example, of a sector of a sphere or cylinder.

In the embodiment illustrated, an annular wall 13 is provided as part of the structure 13, 14, which is fitted concentrically relative to the outlet port areas 21, 24 inside the opening defined thereby. The structure comprises a wall 13, which defines an opening 25 though which an air stream may flow. The wall or the ring 13 is held in place by struts 14, the ends of which remote from the wall are here connected with the wall 12. The wall of the structure 13, and the struts 14 are so shaped that they on the one hand reduce the clear flow cross-section only slightly and on the other hand are in a position to support the structure 13 in stable manner.

Figure 2:
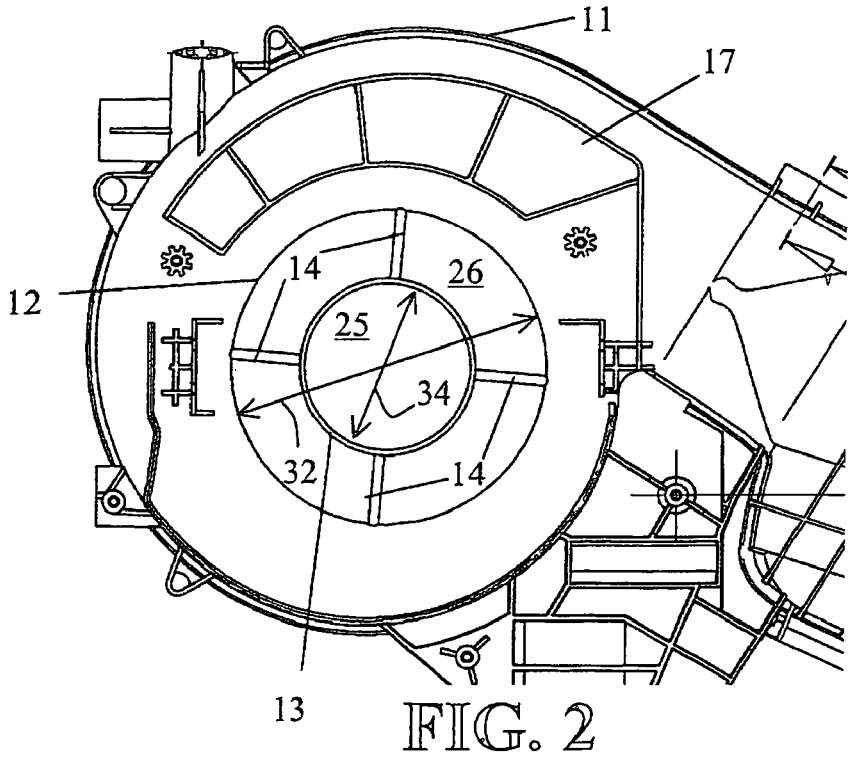
FIG. 2 is a sectional view of this embodiment, orthogonal to the representation of FIG. 1.

FIG. 2 shows a view of the fresh air/recirculated air housing 10, which is orthogonal to the view in FIG. 1. In the fan housing 11, the wall 12 is constructed to be peripherally circumferential and defines a circular opening, in which the structure defining a circular opening 25 is arranged. The annular or cylindrical structure 13 is held in a position by the struts 14 in which it is concentric to the opening formed by the air intake. Neither the wall 13 of the structure nor the struts 14 reduce the clear cross-section of the opening to any noteworthy extent. The opening defined by the air intake, corresponding to the outlet port area, exhibits a diameter 32 and the opening 25 in the structure 13 a diameter 34.

The recirculated air valve 17 is rotatable, whereby it may close one or other of the port areas, or indeed partly open both port areas. In FIG. 2 it is shown in a position in which the fresh air feed is closed and the recirculated air feed is open. As is clear from the illustrations, the structure may be accommodated precisely in the area covered by the fresh air/recirculated air valve, in particular preferably substantially centrally relative thereto.

The structure and the opening 25 defined by the wall 13 thereof are defined in particular by their span in the direction of flow 35 and their diameter 34.

In the embodiment illustrated in FIGS. 1 and 2, the dimensions of the inlet port areas 22, 23 are determined by a span 33 and those of the outlet port areas 21, 24 by a diameter 32. The span 33 is defined between the housing wall 15 and the wall of the fan housing 11 and is designed in the present case appropriately for the fresh air feed and the recirculated air feed. If the spans of the inlet port areas are different, the respectively larger one should be used to determine the parameters.

Particularly effective noise reduction may be achieved if the span 35 of the structure 13 in the flow direction is in a ratio relative to the span 33 of the inlet port areas 22, 23 in which the span 35 comes to between 0.35 times and 0.5 times the corresponding span 33 of the inlet port area. If, as in this case, an annular wall 13 is selected as component of the structure, the length of the wall of this ring amounts to the corresponding proportionate diameter of the inlet port area.

Likewise, the noise-reducing effect may be maximised if the diameter 34 of the annular wall 13 of the structure is in a ratio relative to the diameter of the outlet port area in which the clear cross-section of the opening in the structure comes to between 0.1 times and 0.3 times the clear cross-section of the outlet port area. In the embodiment illustrated with an annular wall 13 as component of the structure, which is arranged in a substantially circular outlet port area, it is thus the case that the diameter of the ring should be between approximately 0.4 times and 0.6 times the diameter of the outlet port area, wherein it has proven particularly advantageous for this value to correspond approximately to 0.52 times the diameter of the outlet port area, as is also shown in the illustration of the preferred embodiment.

Although the present invention has been described above entirely with reference to the currently preferred embodiment, the person skilled in the art should realise that different options for modification are possible within the scope of the attached claims, without deviating from the concept of the invention and the protection claimed. As already explained, the concept of the invention is particularly advantageous for a fresh air/recirculated air application, but is not limited thereto. Furthermore, individual features of one embodiment may also be combined with any desired features of other embodiments. In addition, the structure could also define a plurality of openings, by providing two or more annular walls, for example, for example in concentric arrangement.

The invention claimed is:

1. An air intake having at least one inlet port area (22, 23) and one outlet port area (21, 24) with at least one structure (13, 14) arranged in the outlet port area (21, 24) and the at least one structure may be flowed through and around, the structure (13, 14) includes an opening (25) and the structure (13, 14) includes a span (35) in the flow direction in a ratio between 0.35 times and 0.50 times a corresponding span (33) of the inlet port area (22, 23) wherein the structure (13, 14) comprises a substantially annular wall (13) defining the opening (25) and wherein the clear cross-section of the opening (25) comes to between 0.1 times and 0.3 times the clear cross-section of the outlet port area (21, 24).

2. An air intake according to claim 1, in which the structure (13, 14) is oriented substantially parallel to the outlet port area (21, 24).

3. An air intake according to claim 1, in which the structure (13, 14) is substantially coaxial and/or similar in shape to the outlet port area (21, 24).

4. An air intake according to claim 1, in which at least two inlet port areas (22, 23) are provided.

5. An air intake according to claim 4, in which the inlet port areas (22, 23) are at an angle relative to the outlet port area (21, 24).

6. An air intake according to claim 5, which takes the form of a fan air intake.

7. An air intake according to claim 6, which takes the form of a fresh air/re-circulated air housing for a motor vehicle air-conditioning system.

8. An air intake according to claim 5, in which the inlet port areas (22, 23) are substantially perpendicular to the outlet port area (21, 24).

9. An air intake according to claim 1, in which the at least one inlet port area (22, 23) is provided with an intermediate inlet port area control means.

10. An air intake according to claim 1, in which the substantially annular wall (13) defining the opening (25) is substantially coaxial and/or similar in shape to the outlet port area (21, 24).

* * * * *